US007952599B2

(12) United States Patent
Zhou et al.

(10) Patent No.: US 7,952,599 B2
(45) Date of Patent: May 31, 2011

(54) HEATING ELEMENT INCORPORATING AN ARRAY OF TRANSISTOR MICRO-HEATERS FOR DIGITAL IMAGE MARKING

(75) Inventors: Jing Zhou, Webster, NY (US); Kock-Yee Law, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 10 days.

(21) Appl. No.: 12/474,717

(22) Filed: May 29, 2009

(65) Prior Publication Data

US 2010/0302337 A1 Dec. 2, 2010

(51) Int. Cl.
*G03G 15/20* (2006.01)
*B41J 2/315* (2006.01)

(52) U.S. Cl. ..... 347/171; 347/129; 399/328; 399/335; 399/338

(58) Field of Classification Search ..... 347/111, 347/112, 129, 224, 225, 233, 171; 101/450.1, 101/451, 452; 399/320, 328, 335, 338
See application file for complete search history.

(56) References Cited

U.S. PATENT DOCUMENTS

| | | | | |
|---|---|---|---|---|
| 5,464,966 | A * | 11/1995 | Gaitan et al. | 219/544 |
| 2004/0075140 | A1* | 4/2004 | Baltes et al. | 257/347 |
| 2004/0100526 | A1 | 5/2004 | Silverbrook | |
| 2005/0064633 | A1 | 3/2005 | Mikoshiba | |
| 2005/0136598 | A1 | 6/2005 | Bryant | |
| 2009/0245840 | A1* | 10/2009 | Law | 399/69 |
| 2010/0085585 | A1* | 4/2010 | Stowe et al. | 358/1.7 |
| 2010/0251914 | A1* | 10/2010 | Zhou et al. | 101/453 |

FOREIGN PATENT DOCUMENTS

| | | |
|---|---|---|
| EP | 1 033 249 A1 | 9/2000 |
| EP | 1 324 395 A2 | 7/2003 |

OTHER PUBLICATIONS

Graf, M., et al., Transistor Heater for Microhotplate-Based Metal-Oxide Microsensors, IEEE Electron Device Letters, vol. 26, No. 5, May 2005, pp. 295-297.*
Graf, M., et al., Micro Hot Plate-Based Senor Array System for the Detection of Environmentally Relevant Gases, Analytical Chemistry, vol. 78, No. 19, Oct. 1, 2006, pp. 6801-6808.*
Imparato, Antonio, et al., Excimer Laser Induced Crystallization of Amorphous Silicon on Flexible Polymer Substrates, www.sciencedirect.com, Thin Solid Films 487 (2005), pp. 58-62.*
Hekmatshoar, Bahman, et al., Low-Temperature Non-Metal-Induced Crystallization of Germanium for Fabrication of Thin-Film Transistors, www.sciencedirect.com, Materials Science in Semiconductor Processing 7 (2004), pp. 419-422.*
Mofor, A.C., et al., Growth of ZnO Layers for Transparent and Flexible Electronics, www.sciencedirect.com, Thin Solid Films 516 (2008), pp. 1401-1404.*
U.S. Appl. No. 12/060,427, filed Apr. 1, 2008, Law.*
U.S. Appl. No. 12/245,578, filed Oct. 3, 2008, Stowe, et al.*
U.S. Appl. No. 12/416,189, filed Apr. 1, 2009, Zhou, et al.*
European Search Report dated Jan. 28, 2011.

* cited by examiner

*Primary Examiner* — Huan H Tran
(74) *Attorney, Agent, or Firm* — Fay Sharpe LLP

(57) ABSTRACT

The exemplary embodiments disclosed herein incorporate transistor heating technology to create micro-heater arrays as the digital heating element for various marking applications. The transistor heaters are typically fabricated either on a thin flexible substrate or on an amorphous silicon drum and embedded below the working surface. Matrix drive methods may be used to address each individual micro-heater and deliver heat to selected surface areas. Depending on different marking applications, the digital heating element may be used to selectively tune the wettability of thermo-sensitive coating, selectively change ink rheology, selectively remove liquid from the surface, selectively fuse/fix toner/ink on the paper.

23 Claims, 10 Drawing Sheets

HEATING ELEMENT INCORPORATING AN ARRAY OF TRANSISTOR MICRO-HEATERS FOR DIGITAL IMAGE MARKING

BACKGROUND

The exemplary embodiments disclosed herein relate to heating elements incorporating arrays of transistor micro-heaters for printing and image marking applications.

By way of background, current heat-based image marking engines incorporate either thermal print head or laser heating technology. The thermal print head must physically contact the surface in order to directly deliver heat to selected pixels, which restricts its application away from non-contact required environment, such as the nip region between two rollers. Also, the thermal print head is slow and energy inefficient. In the laser heating technology, optical energy is absorbed and converted to heat, providing an ideal non-contact heating mechanism. The total power requirement for addressing a large-area surface at reasonably high speed, however, is extremely high compared to common high power laser systems. The lack of an inexpensive, powerful laser and the complexity of optical systems make it nearly impossible to create a fast, compact, and cheap heat-based marking engine using current laser technology.

Accordingly, there is a need to overcome these and other problems of the prior art to provide digital fusing subsystems that can reduce the amount of wasted heat, for example, by heating only those areas where the toner image will be.

INCORPORATION BY REFERENCE

The following patents/applications, the disclosures of each being totally incorporated herein by reference, are mentioned:

U.S. application Ser. No. 12/060,427, filed Apr. 1, 2008, entitled DIGITAL FUSER CONCEPT USING MICRO HOTPLATE TECHNOLOGY, by Law;

U.S. application Ser. No. 12/245,578, filed Oct. 3, 2008, entitled DIGITAL IMAGING OF MARKING MATERIALS BY THERMALLY INDUCED PATTERN-WISE TRANSFER, by Stowe, et al.; and U.S. application Ser. No. 12/416,189, filed Apr. 1, 2009, entitled IMAGING MEMBER, by Zhou, et al.

BRIEF DESCRIPTION

Transistors have been used as micro-heaters in chemical sensor application. Transistor heaters with a dimension of 200 μm fabricated by conventional CMOS techniques on silicon wafers can heat up to 350° C. with thermal response time in the order of milliseconds. The exemplary embodiments disclosed herein leverage transistor heating technology to create micro-heater arrays as the digital heating element for various marking applications. The transistor heaters are typically fabricated either on a thin flexible substrate or on an amorphous silicon drum and embedded below the working surface. Matrix drive methods may be used to address each individual micro-heater and deliver heat to selected surface areas. Depending on different marking applications, the digital heating element may be used to selectively tune the wettability of thermo-sensitive coating, selectively change the ink rheology, selectively remove liquid from the surface, selectively fuse/fix toner/ink on the paper.

In one embodiment, an image marking system is provided. The image marking system includes one or more digital heating elements, the digital heating element comprising a micro-heater array having thermally isolated and individually addressable transistor micro-heaters that can attain a temperature up to approximately 200° C. from approximately 20° C. within a few milliseconds.

In another embodiment, a method of forming an image is provided. The method comprises: forming a toner or ink image on an imaging member; and providing a fixing subsystem comprising one or more digital heating elements, wherein the digital heating element comprises a micro-heater array having thermally isolated and individually addressable transistor micro-heaters; selectively heating one or more transistor micro-heaters that correspond to the toner or ink image to a temperature in the range of approximately 20° C. to approximately 200° C. in a few milliseconds; and feeding the media through the fuser subsystem to fix the toner or ink image on the media.

In yet another embodiment, a method of forming an ink image is provided. The method comprises: feeding a media in a digital lithographic development subsystem comprising an imaging member, wherein the imaging member comprises a wettability switchable surface and one or more digital heating elements that comprise an array of transistor micro-heaters, wherein each micro-heater is thermally isolated and individually addressable; changing the surface of the imaging member on the image areas from ink-repelling state to ink-attracting state by heating one or more micro-heaters that correspond to the image areas to a temperature in the range of approximately 20° C. to approximately 200° C. in a few milliseconds; forming an ink image by applying ink to the image areas that are ink-attracting; transferring the ink image from the imaging member onto the media; and transporting the media to a fixing station.

In yet another embodiment, a method of forming an ink image is provided. The method comprises: feeding a media in a digital lithographic development subsystem comprising an imaging member, wherein the imaging member comprises a wettability switchable surface and one or more digital heating elements that comprise an array of transistor micro-heaters, wherein each micro-heater is thermally isolated and individually addressable; applying a thin fountain solution film on the imaging member; removing fountain solution from the image areas by heating one or more micro-heaters that correspond to the image areas to a temperature in the range of approximately 20° C. to approximately 200° C. in a few milliseconds; forming a ink image by applying ink to the image areas where fountain solution is removed; transferring ink image onto the media; and transporting the media to a fixing station.

In yet another embodiment, a method of forming an ink image comprises: feeding a media in a digital lithographic development subsystem comprising an imaging member, wherein the imaging member comprises a wettability switchable surface and one or more digital heating elements that comprise an array of transistor micro-heaters, wherein each micro-heater is thermally isolated and individually addressable; applying a waterless lithographic ink film on the imaging member; changing the rheological properties of the waterless lithographic ink on the image areas by heating one or more micro-heaters that correspond to the image areas to a temperature in the range of approximately 20° C. to approximately 200° C. in a few milliseconds; transferring the rheology-modified ink image from imaging member onto the media; and transporting the media to a fixing station.

DETAILED DESCRIPTION

Figure 1:
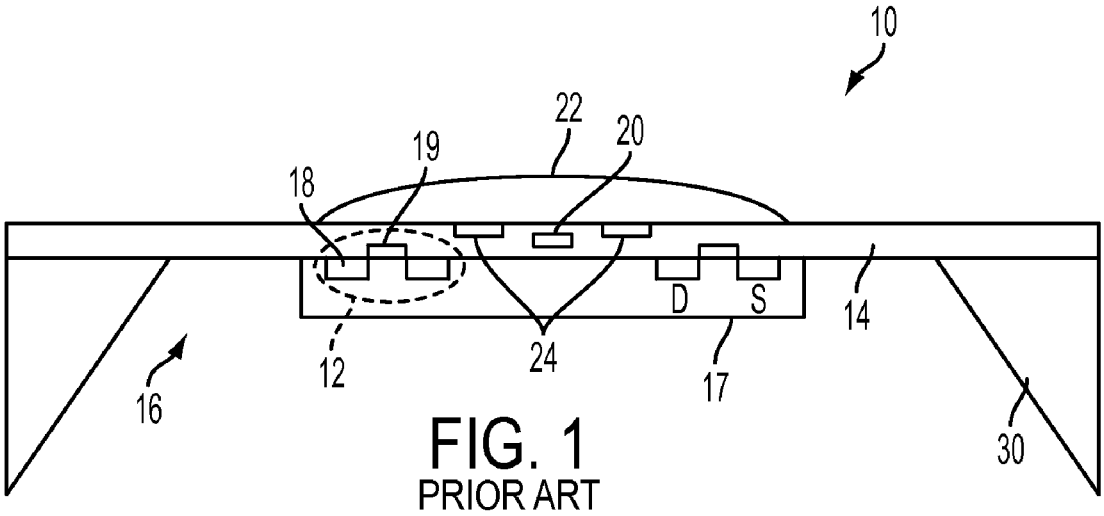
FIG. 1 PRIOR ART
FIG. 1 is a cross-sectional view of a micro-hotplate with an integrated pMOS transistor heater.

A schematic view of an example of a prior art micro-hotplate-based chemical sensor 10 with an integrated PMOS transistor heater 12 is shown in FIG. 1. In order to ensure a good thermal insulation, only the dielectric layers of the CMOS process form the membrane 14. The inner section 16 of the dielectric membrane 14 includes an n-well silicon island 17 (e.g., 300 μm base length) underneath the dielectric layers (e.g., 500×500 μm). The n-well 17 is electrically insulated and serves as heat spreader owing to the good thermal conductivity of silicon. It also hosts the pMOS transistor heating element 12, which includes p-diffusion 18 and a gate 19 (e.g., 5 μm gate length and 710 μm overall gate width). A special ring-shape transistor arrangement improves homogeneous heat distribution. A poly-silicon resistor 20 is used to measure the temperature on the micro-micro-heater 10. The resistance of the nanocrystalline SnO thick-film layer 22 is read out by means of two noble-metal-coated (Pt) electrodes 24 for detecting the molecule induced resistance change in SnO film.

The device fabrication relies on an industrial 0.8-μm CMOS process (austriamicrosystems, Unterpremstätten, Austria) combined with post-CMOS micromachining steps. The inner section 16 of the membrane 14 (e.g., 500×500 μm) exhibits an octagonal-shape n-well silicon island 18 (e.g., 300 μm base length). The octagonal shape provides a comparatively large distance between the heated membrane area and the cold bulk chip [close up in FIG. 2]. Furthermore, this symmetric shape promotes homogeneous heat distribution. A resistive polysilicon temperature sensor 20 (connected to circuitry) that measures membrane temperature ($T_M$) is located at the center. Bulk silicon 30 is not part of the electronic device, but it does provide mechanical support for the suspended micro-micro-heater.

The thermal efficiency is 5.8° C./mW and the thermal time constant is 9 ms for this specific transistor heater. Depending on the size, geometry, arrangement, and material of a transistor heater, its properties could vary a lot. In general, this type of transistor heater can heat up to 350° C. with thermal response time in the order of millisecond.

Following the design of the digital heating element based on resistive heater arrays in prior art, a new digital heating element based on transistor micro-heater arrays consisting of thousands to millions of micron-sized transistor heaters was developed. There are some differences between these two types of micro-heaters. The resistive heater can heat up to 1000° C. if tungsten is used as the resistive material. By contrast, the transistor heater fabricated on a silicon wafer can only reach about 350° C. because the transistor will burn out above this temperature.

Figure 3:
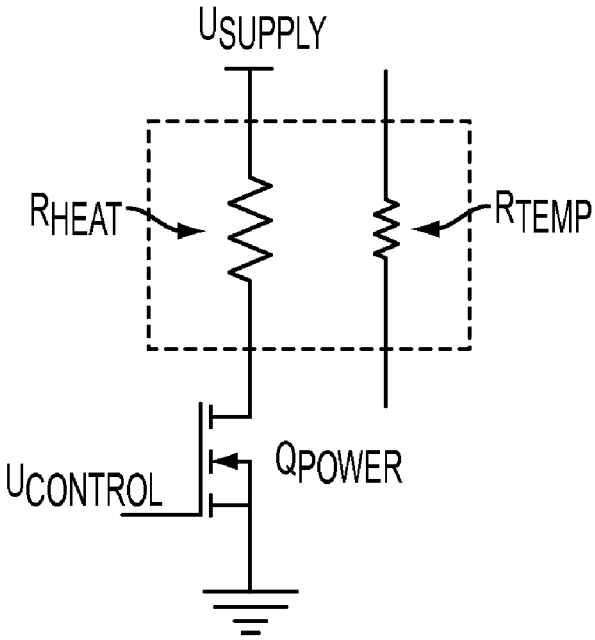
FIG. 3 is a schematic diagram of a resistive heating element.
Figure 4:
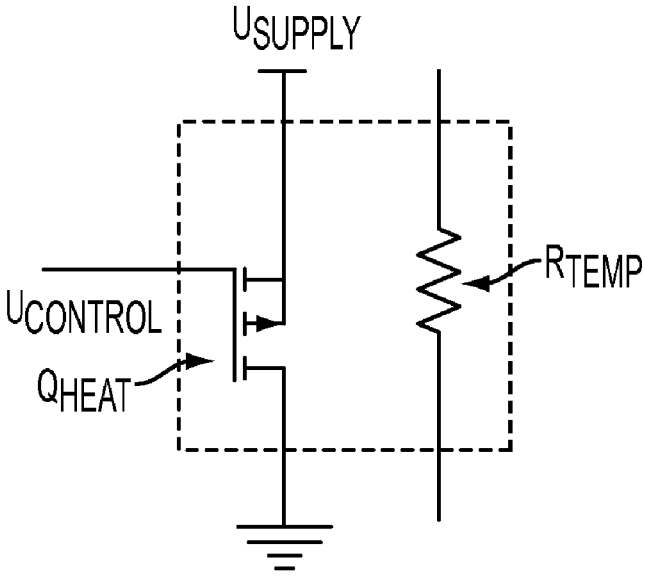
FIG. 4 is a schematic diagram of a transistor heating element.

Schematic diagrams of the two micro-heating schemes are shown in FIG. 3 (resistive heating) and in FIG. 4 (transistor heating). FIG. 3 shows a basic unit of resistive heating array including a heating resistor ($R_{HEAT}$), a power transistor ($Q_{POWER}$), and a temperature monitoring resistor ($R_{TEMP}$). The power transistor is required for switching the micro-heater by controlling the gate voltage ($U_{control}$) of the power transistor. The supplied voltage ($U_{supply}$) is split between the heating resistor and the power transistor. The temperature monitoring resistor may be added to the basic unit for feedback control on temperature. FIG. 4 shows a basic unit of a transistor heating array, including a heating transistor ($Q_{HEAT}$) and a temperature monitoring resistor ($R_{TEMP}$). Similarly, switching of the micro-heater is controlled by the gate voltage ($U_{control}$).

Figure 5:
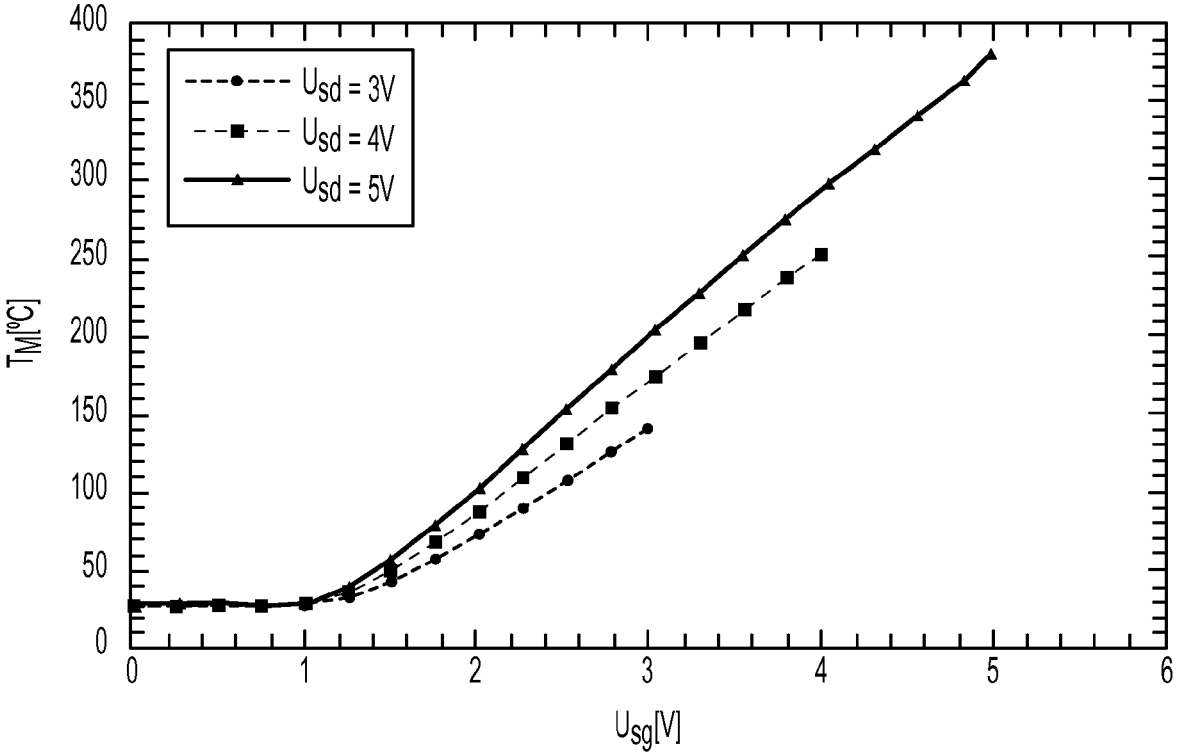
FIG. 5 is a graph showing that the membrane temperature of the transistor heater-based chemical sensor (FIG. 1) varies as a function of source-gate voltage for different source-drain voltages.

Generally, the highest temperature is limited for all types of transistor heaters. However, the transistor heaters are more energy efficient since resistive heaters require power transistors to switch on/off and a massive fraction of the overall power is dissipated on power transistors, as illustrated in FIG. 3. Furthermore, the resistance of the heating transistor varies with its source-gate voltage, thus leading to a linear dependence of the micro-heater temperature $T_M$ on the transistor source-gate voltage $U_{sg}$ for $U_{sg}$ above the threshold voltage, as shown in FIG. 5. This provides a simple approach to control the temperature of each individual micro-heater.

It is possible to leverage and extend the transistor micro-heater technology for different marking applications, such as direct marking in digital lithographic press and transfuse/transfix device in dry and liquid xerography. This involves the construction of a large area heating surface consisting of an array of transistor micro-heaters with the size from several microns to hundred of microns using a combination of CMOS, printable electronic and nanofabrication technologies.

Figure 6:
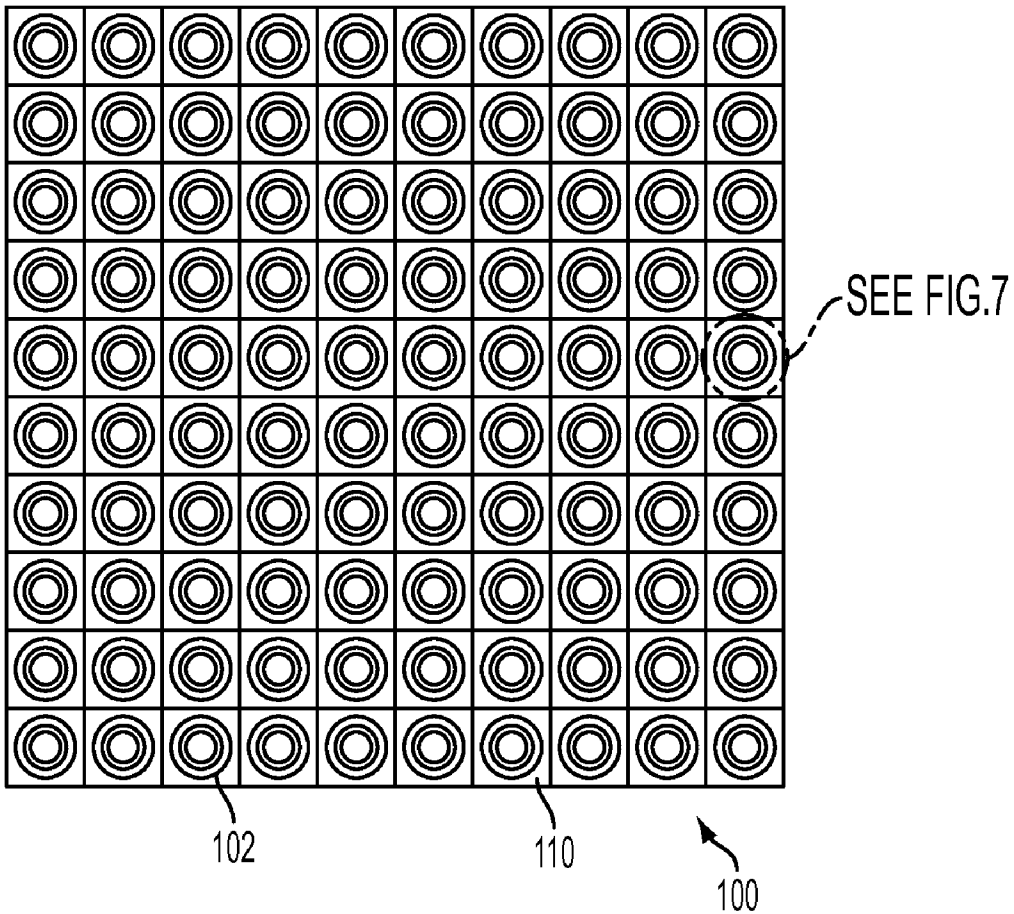
FIG. 6 is a schematic diagram of an array of 10×10 transistor micro-heaters in accordance with aspects of the exemplary embodiments.

FIG. 6 is a top view of an exemplary example of a digital heating element (or device) 100 with a 10×10 array of transistor micro-heaters 102 (electrodes and wires are removed for better viewing). Each micro-heater 102 of the array of heaters can be thermally isolated and can be individually addressable, and each micro-heater 102 can be configured to attain a temperature of up to approximately 200° C. from approximately 20° C. in a time frame of milliseconds. In some embodiments, the time frame of milliseconds can be less than about 100 milliseconds. In other embodiments, the time frame of milliseconds can be less than about 50 milliseconds. Yet, in some other embodiments, the time frame of milliseconds can be less than about 10 milliseconds. The phrase "individually addressable" as used herein means that each micro-heater 102 of the array of micro-heaters can be identified and manipulated independently of its surrounding heaters, for example, each micro-heater 102 can be individually turned on or off or can be heated to a temperature different from its surrounding heaters. However, in some embodiments, instead of addressing the micro-heaters individually, a group of micro-heaters including two or more heaters can be addressed together, i.e., a group of micro-heaters can be turned on or off together or can be heated to a certain temperature together, different from the other micro-heaters or other groups of micro-heaters.

Figure 7:
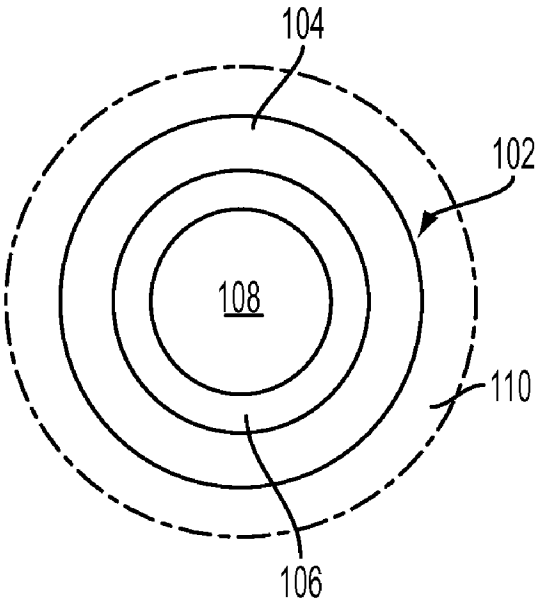
FIG. 7 is a close up of a transistor micro-heater from FIG. 6.

FIG. 7 is a close-up showing the source 104, the channel 106 and the drain 108 of the transistor micro-heater 102. Though the transistors 102 in this example have a circular shape, other shapes can be made as well (e.g., polygon, ribbon, and spiral). The transistor micro-heater array 100 is directly embedded below the work surface 110 for fast and efficient heating.

Figure 8:
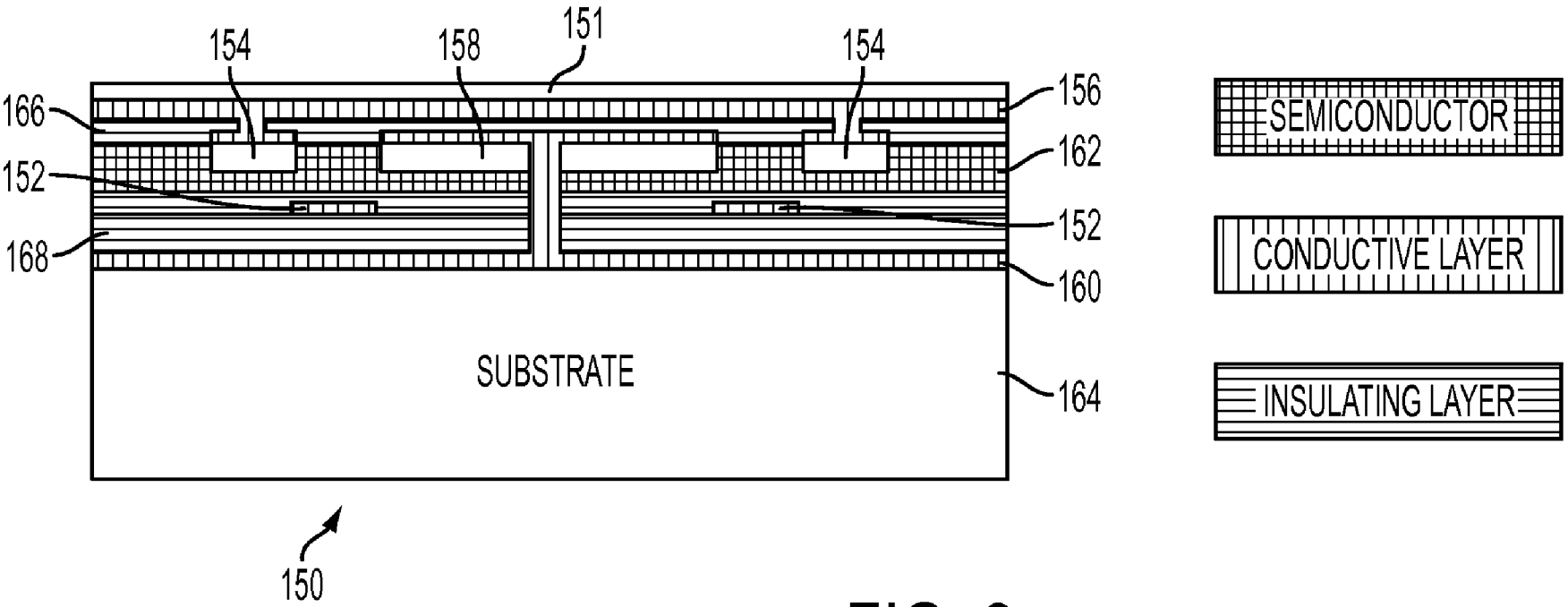
FIG. 8 is a cross-section view of an axis-symmetric design of a single transistor micro-heater in accordance with aspects of the exemplary embodiments.

A cross-section of this design is shown in FIG. 8. In order to generate and distribute heat uniformly, an axis symmetric shape may be chosen for the transistor micro-heater design. But the actual micro-heater 150 is not limited to axis symmetric shapes, as long as heat distribution is homogeneous across the top surface (the working surface) 151. The transistor micro-heater 150 includes a ring-shaped bottom gate 152, a ring-shaped source 154 connected to an upper conductive metal layer 156, and a round drain 158 connected to a lower conductive metal layer 160. The use of metal layers has at least two purposes: (1) it reduces power wasted on the wire interconnections since a huge current must be supplied to each transistor, and (2) it helps to distribute heat uniformly across the surface. The semiconductor layer 162 is several microns thick and is composed of either inorganic or organic materials with high electron mobility (>10 $cm^2/V\cdot s$). The substrate layer 164 is generally either a flexible plastic with very low thermal conductivity or a thermal insulating material coated on a drum. Basically, any low thermal conductivity materials ($k<1\ Wm^{-1}K^{-1}$) can be used as a substrate layer. The thickness of the substrate layer 164 is generally between 50 μm and several millimeters. The relative thickness of the upper and lower conductive layers 156, 160 and the upper and lower electrically insulating dielectric layers 166, 168 is in the neighborhood of only a few hundreds of nanometers. Thus, with this design it is now possible to provide a constant voltage between the upper metal layer (source) and the lower metal layer (drain) and simply change the gate voltage to adjust heating power and the temperature.

In certain embodiments, the top surface 151 in FIG. 8 may comprise a thermal spreading layer. The thickness of the thermal spreading layer can be from about 5 μm to about 50 μm, and in some cases from about 10 μm to about 30 μm. In some embodiments, the thermal spreading layer can include thermally conductive fillers disposed in a polymer. In various embodiments, the thermally conductive fillers can be selected from the group consisting of graphites; graphenes; carbon nanotubes; micron to submicron sized metal particles, such as, for example, Ni, Ag, and the like; and micron to submicron sized ceramic fillers, such as SiC, $Al_2O_3$, and AlN. In other embodiments, the polymer in which the thermally conductive fillers are disposed can be selected from the group consisting of polyimides, silicones, fluorosilicone, and fluoroelastomers. However, one of ordinary skill in the art may choose any suitable thermally conductive filler disposed in any suitable polymer A combination of photolithography, printed electronics, and nanofabrication technologies can be used to fabricate the transistor micro-heater arrays. The fabrication process depends on the type of materials used and the type of substrate. For example, if the micro-heater array is fabricated on a flexible substrate, photolithography technology may be used to create insulating layers, metal layers, and interconnections while printed electronics and nanofabrication technologies may be used to create semiconductor layers. Electron mobility is a key requirement for semiconductor materials used in transistor micro-heaters. The amorphous silicon-based thin film transistors cannot generate enough heating power because the maximum current is limited by amorphous silicon's low electron mobility (1 $cm^2V^{-1}S^{-1}$), and a polysilicon-like material is required for the transistor channel due to their higher electron mobility (>30 $cm^2V^{-1}S^{-1}$). One possible way of making a high performance transistor channel is to use known excimer laser-induced crystallization or metal-induced crystallization or other similar crystallization methods to crystallize deposited amorphous semiconductor materials, such as amorphous silicon and amorphous germanium. Metal-induced crystallization (MIC) is a method by which amorphous silicon, or a-Si, can be turned into polycrystalline silicon at relatively low temperatures. In MIC an amorphous Si film is deposited onto a substrate and then capped with a metal, such as aluminum. The structure is then annealed at temperatures between 150° C. and 400° C., thus causing the a-Si films to be transformed into polycrystalline silicon. ZnO thin film is also a promising high electron mobility material that can be deposited on flexible substrates and curved surfaces.

Figure 9:
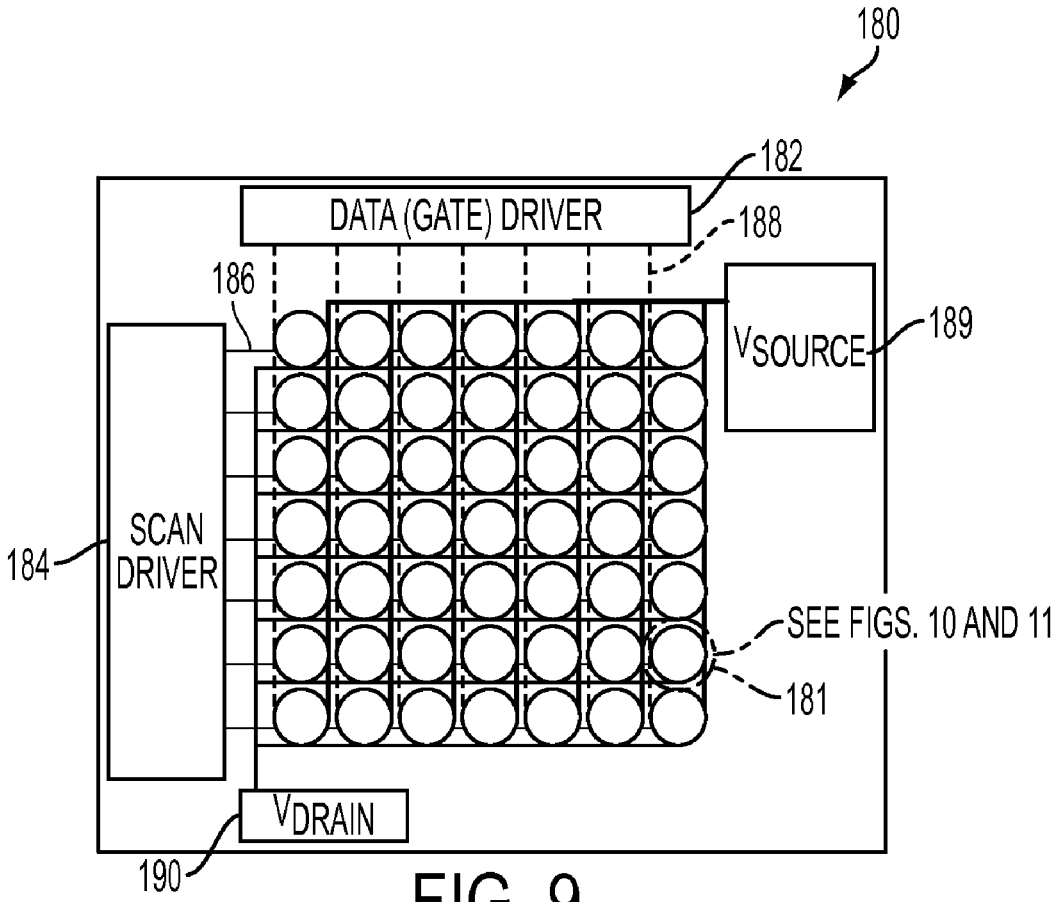
FIG. 9 is a schematic diagram showing a simplified matrix drive for addressing individual transistor micro-heater.
Figure 10:
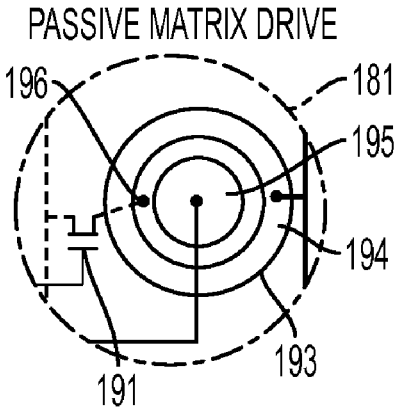
FIG. 10 is a zoom-in of a single micro-heater design with passive matrix drive.
Figure 11:
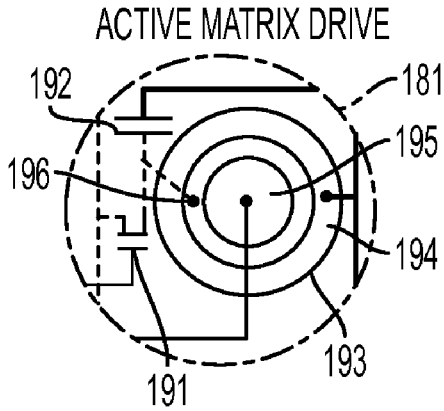
FIG. 11 is a zoom-in of a single micro-heater design with active matrix drive.

Passive matrix drive or active matrix drive can be used to address each individual micro-heater, as illustrated in FIGS. 9-11. Active matrix drive and passive matrix drive are two pixel-addressable mechanisms used in LCD technology. An exemplary digital heating element (or device) 180 comprising a 10×10 array of transistor micro-heaters 181 is shown in FIG. 9. The transistor micro-heater 181 generally has a length and width in between 10 μm and 500 μm. The data driver 182 provides 10 data drive lines 188 and the scan driver 184 provides 10 scan drive lines 186. At each intersection of data drive lines 188 and scan drive lines 186 is a heating transistor 193 and its switching transistor 191 as shown in FIGS. 10 and 11. The source electrodes 194 and drain electrodes 195 of the heating transistors 193 are connected to the same $V_{Source}$ 189 and $V_{Drain}$ 190, respectively. Each switching transistor 191 has a gate terminal connected to a scan drive line 186, a source terminal connected to a data drive line 188, and a drain terminal connected to the gate electrode 196 of the heating transistor 193. Each heating transistor 193 is addressed by activating its switching transistor 191 via its scan drive line 186 and sending control signal to its gate electrode 196 via its data drive line 188. The selection of passive matrix drive or active matrix drive depends on the application requirement.

In passive matrix drive (see FIG. 10), the scan driver 184 scans all micro-heaters 181 row by row and in each time interval only one row of switching transistors 191 are activated so that data driver 182 can change the gate 196 voltage of individual heating transistor 193 through data drive lines 188. However, the heating transistor 193 is turned off as soon as the scan driver moves to the next row, which is a passive response to addressing signals. In this passive drive mechanism, no more than one row of micro-heaters 181 can operate in each time inverval. Thus, passive matrix drive works better for relatively small micro-heater arrays (less than 1000 rows). In contrast, active matrix drive (see FIG. 11) is preferred for operating fast (scanning rate greater than 20 Hz) and large area transistor arrays (more than 1000 rows). As indicated in FIG. 11, an extra capacitor 192 is inserted with one end connected to $V_{Source}$ and other end connected to the gate electrode 196 of the heating transistor 193. The addressing mechanism of active matrix drive is similar to passive matrix drive except that the capacitor 192 can actively maintain the source-gate voltage, and consequently operating status of the heating transistor 193, even after scan driver moves to another row. Therefore, more than one row of micro-heaters 181 may be operating at the same time, and, if needed, each individual micro-heater can be turned off by another addressing signal via its scan drive line 186 and data drive line 188.

The digital heating element comprising a transistor micro-heater array described herein can be integrated into different types of marking systems for various applications. In one example, a fuser subsystem with integrated digital heating element in an electrophotographic printer can selectively fuse or fix toner or liquid toner image on a printing media.

Figure 12:
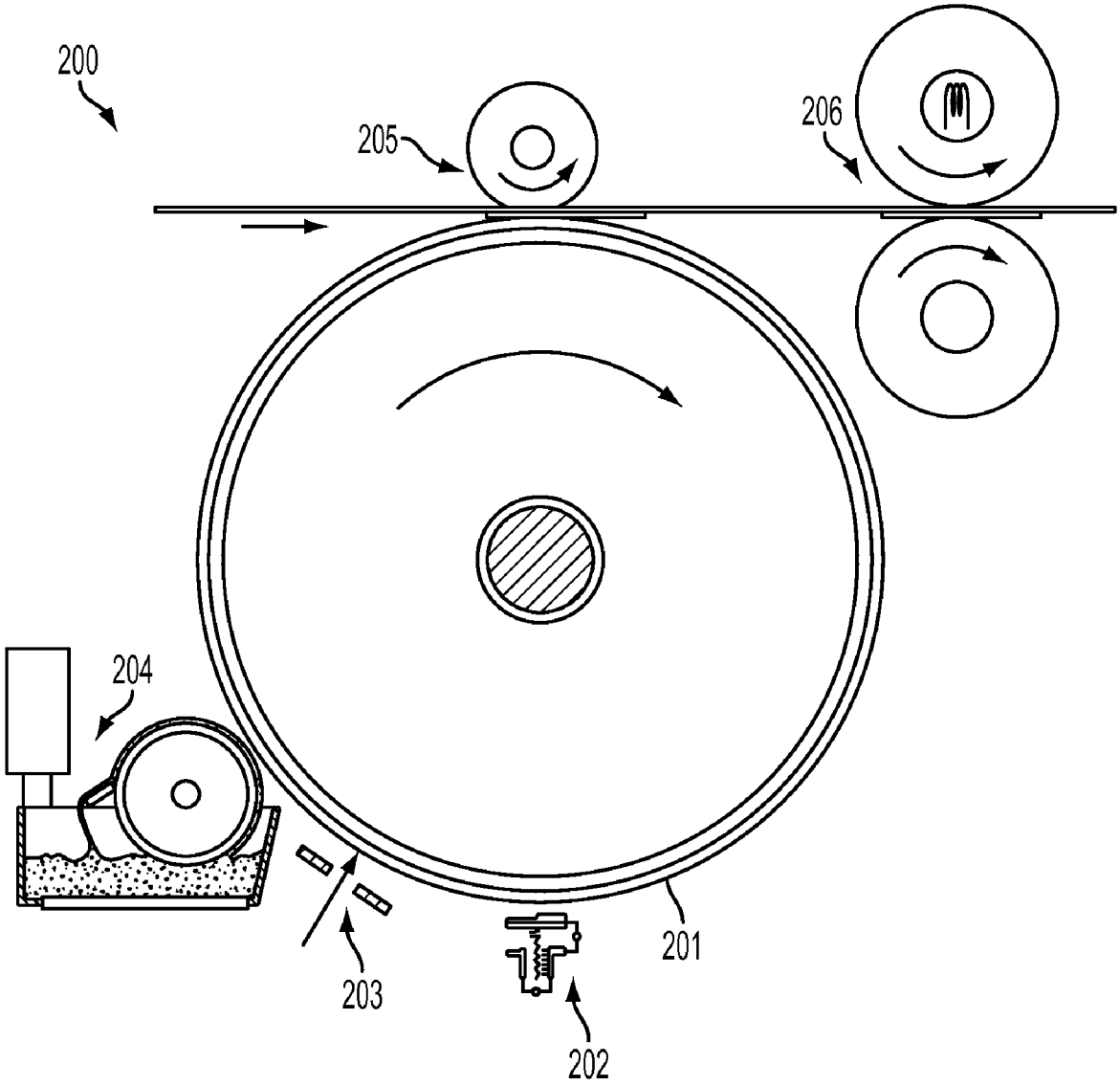
FIG. 12 schematically illustrates an exemplary printing apparatus.

FIG. 12 schematically illustrates an exemplary printing apparatus 200, which includes an electrophotographic photoreceptor 201 and a charging station 202 for uniformly charging the electrophotographic photoreceptor 201. The electrophotographic photoreceptor 201 can be a drum photoreceptor as shown in FIG. 1 or a belt photoreceptor (not shown). The printing apparatus 200 also includes an imaging station 203 where an original document (not shown) can be exposed to a light source (also not shown) for forming a latent image on the electrophotographic photoreceptor 201. The printing apparatus 200 further includes a development subsystem 204 for converting the latent image to a visible image on the electrophotographic photoreceptor 201 and a transfer subsystem 205 for transferring the visible image onto a media and a fuser subsystem 206 for fixing the visible image onto a media.

Figure 15:
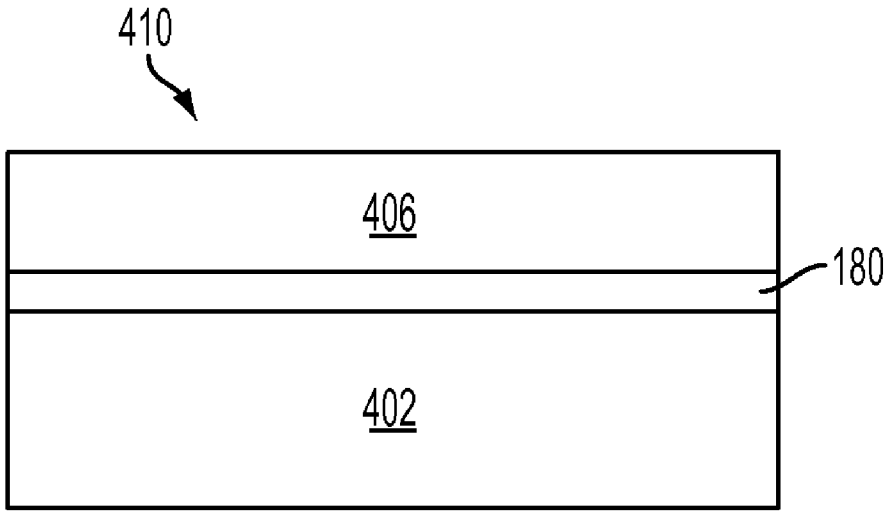
FIG. 15 schematically illustrates a cross section of an exemplary fuser member, according to various embodiments of the present teachings.
Figure 16:
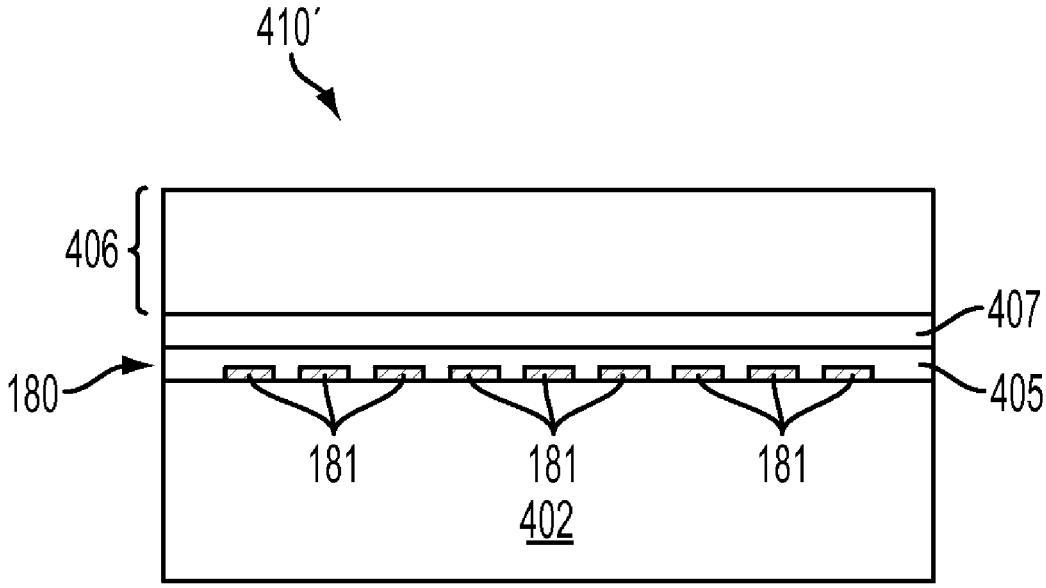
FIG. 16 schematically illustrates a cross section of another exemplary fuser member, according to various embodiments of the present teachings.

The fuser subsystem 206 includes one or more digital heating elements 180 as shown in FIG. 9. The fuser subsystem 206 can include one or more of a fuser member, pressure members, external heat rolls, oiling subsystems, and transfix rolls. FIG. 15 shows an exemplary fuser member 410 including a digital heating element 180 disposed over a substrate 402 and a toner release layer 406 disposed over the digital heating element 180. The substrate 402 can be a high temperature plastic substrate such as polyimide or PEEK. The thickness of the substrate 402 can be from about 50 μm to about 150 μm, and in some cases from about 65 μm to about 85 μm. The toner release layer 406 is typically a single layer including materials such as silicone, fluorosilicone or fluoroelastomer. The thickness of the toner release layer 406 can be from about 100 μm to about 500 μm, and in some cases from about 150 μm to about 250 μm. The toner release layer 406 can also be a double layer structure including a fluoroelastomer layer disposed over a silicone rubber layer. In some other embodiments, the toner release layer 406 can be a double layer structure including a thermoplastic layer such as PTFE or PFA disposed over a silicone rubber layer. The total thickness of the double layer structure of the toner release layer 406 can be from about 100 μm to about 500 μm, and in some cases from about 150 μm to about 250 μm, with the top layer thickness from about 20 μm to about 30 μm. In some embodiments, an electrically insulating layer 405 can be disposed over the digital heating element 180 including an array of micro-heaters 181, as shown in FIG. 16. In various embodiments, the electrically insulating layer 405 can include any suitable material such as, for example, silicon oxide, polyimide, silicone rubber, fluorosilicone, and a fluoroelastomer. The thickness of the electrically insulating layer 405 can be from about 10 μm to about 50 μm, and in some cases from about 20 μm to about 30 μm. In certain embodiments, a thermal spreading layer 407 can be disposed over the electrically insulating layer 405, as shown in FIG. 16. The thickness of the thermal spreading layer 407 can be from about 10 μm to about 50 μm, and in some cases from about 20 μm to about 30 μm. In some embodiments, the thermal spreading layer 407 can include thermally conductive fillers disposed in a polymer. The thermally conductive fillers can be selected from the group consisting of graphites; graphenes; carbon nanotubes; micron to submicron sized metal particles, such as, for example, Ni, Ag, and the like; and micron to submicron sized ceramic fillers, such as, for example, SiC, $Al_2O_3$, and AlN. The polymer in which the thermally conductive fillers are disposed can be selected from the group consisting of polyimides, silicones, fluorosilicone, and fluoroelastomers. However, one of ordinary skill in the art may choose any suitable thermally conductive filler disposed in any suitable polymer.

Referring back to the digital heating element 180 disposed over the substrate 402, the digital heating elements 180 can include an array of micro-heaters 181, as shown in FIG. 9. Each micro-heater 181 of the array of micro-heaters can be thermally isolated and can be individually addressable, and wherein each micro-heater 181 can be configured to attain a temperature of up to approximately 200° C. from approximately 20° C. in a time frame of milliseconds. In some embodiments, the time frame of milliseconds can be less than about 100 milliseconds. In other embodiments, the time frame of milliseconds can be less than about 50 milliseconds. Yet, in some other embodiments, the time frame of milliseconds can be less than about 10 milliseconds. The phrase "individually addressable" as used herein means that each micro-heater 181 in the array can be identified and manipulated independently of its surrounding micro-heaters, for example, each micro-heater 181 can be individually turned on or off or can be heated to a temperature different from its surrounding micro-heaters. However in some embodiments, instead of addressing the micro-heaters individually, a group of micro-heaters including two or more micro-heaters can be addressed together, that is, a group of micro-heaters can be turned on or off together or can be heated to a certain temperature together, different from the other micro-heaters or other groups of micro-heaters. For example, in the case of printing text with a certain line spacing and margins, the micro-heaters corresponding to the text can be heated to a certain temperature to fuse the toner, but the micro-heaters corresponding to the line spacing between the text and the margins around the text can be turned off.

Figure 2:
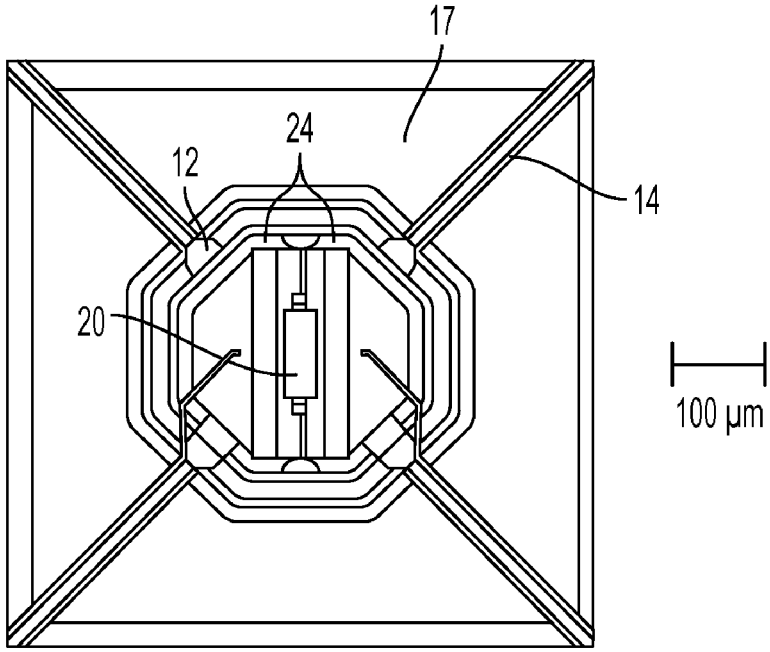
FIG. 2 PRIOR ART
FIG. 2 is a close-up of the inner section of the micro-hotplate.
Figure 13:
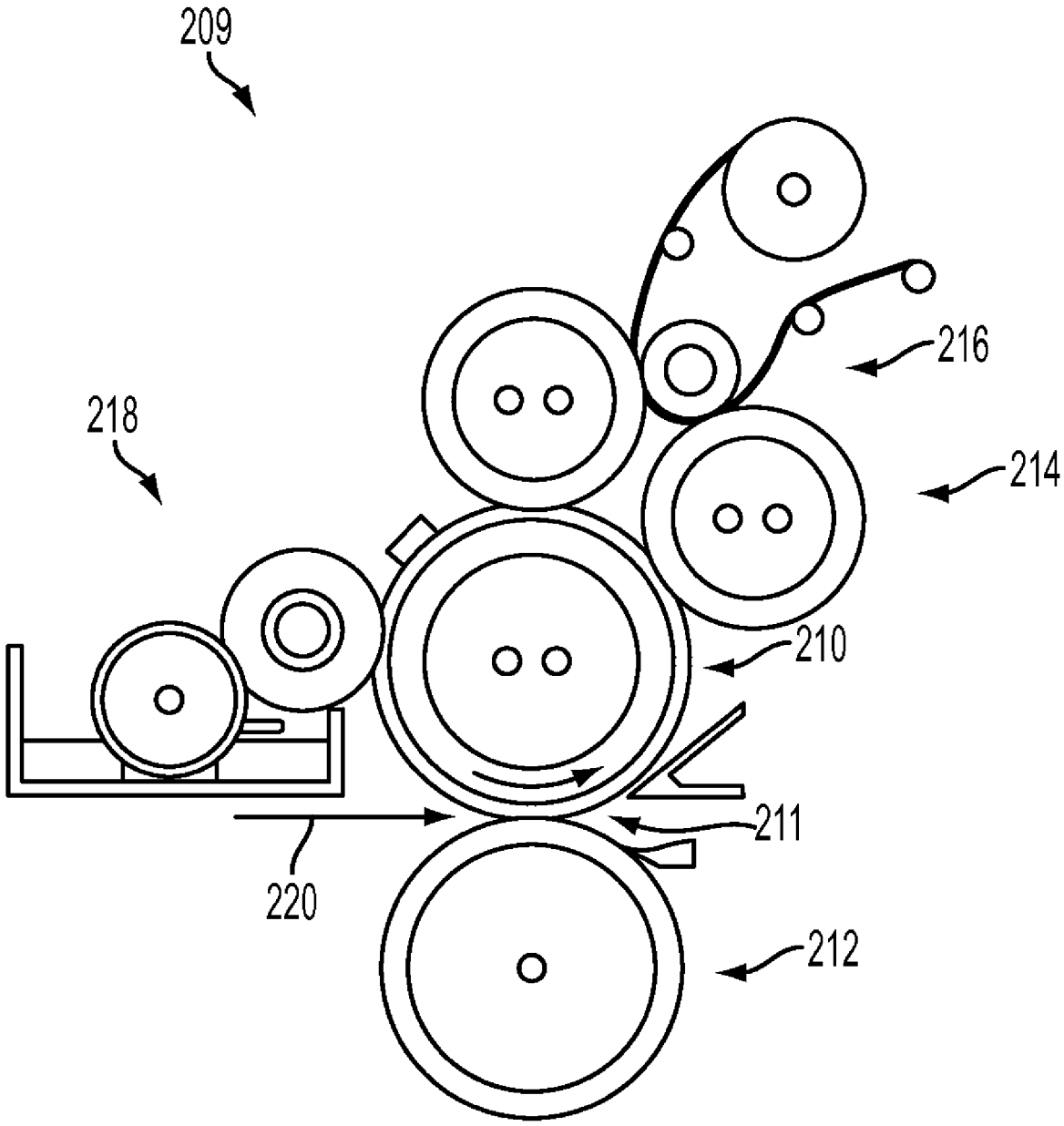
FIG. 13 schematically illustrates an exemplary fuser subsystem of a printing apparatus, according to various embodiments of the present teachings.

FIG. 13 schematically illustrates an exemplary fuser subsystem 209 of a xerographic printer. The fuser subsystem 209 includes a fuser member 210 and a rotatable pressure member 212 that can be mounted forming a fusing nip 211. A media 220 carrying an unfused toner image can be fed through the fusing nip 211 for fusing. The pressure member 212 can be a pressure roll (as shown in FIG. 2) or a pressure belt (not shown). The fuser subsystem 209 can also include an oiling subsystem 218 to oil the surface of the fuser member 210 to ease the removal of residual toner. The fuser subsystem 201 can further include external heat rolls 214 to provide additional heat source and cleaning subsystem 216. In various embodiments, one or more of fuser member 210, pressure members 212, external heat rolls 214, and oiling subsystem 218 can include digital heating element 180. In various embodiments, the digital heating elements 180 can be used as a heat source and can be disposed in the pressure member 212, the external heat rolls 214, and the oiling subsystem 218 in a configuration similar to that for the fuser member 410 as disclosed above and shown in FIGS. 15 and 16.

Figure 14:
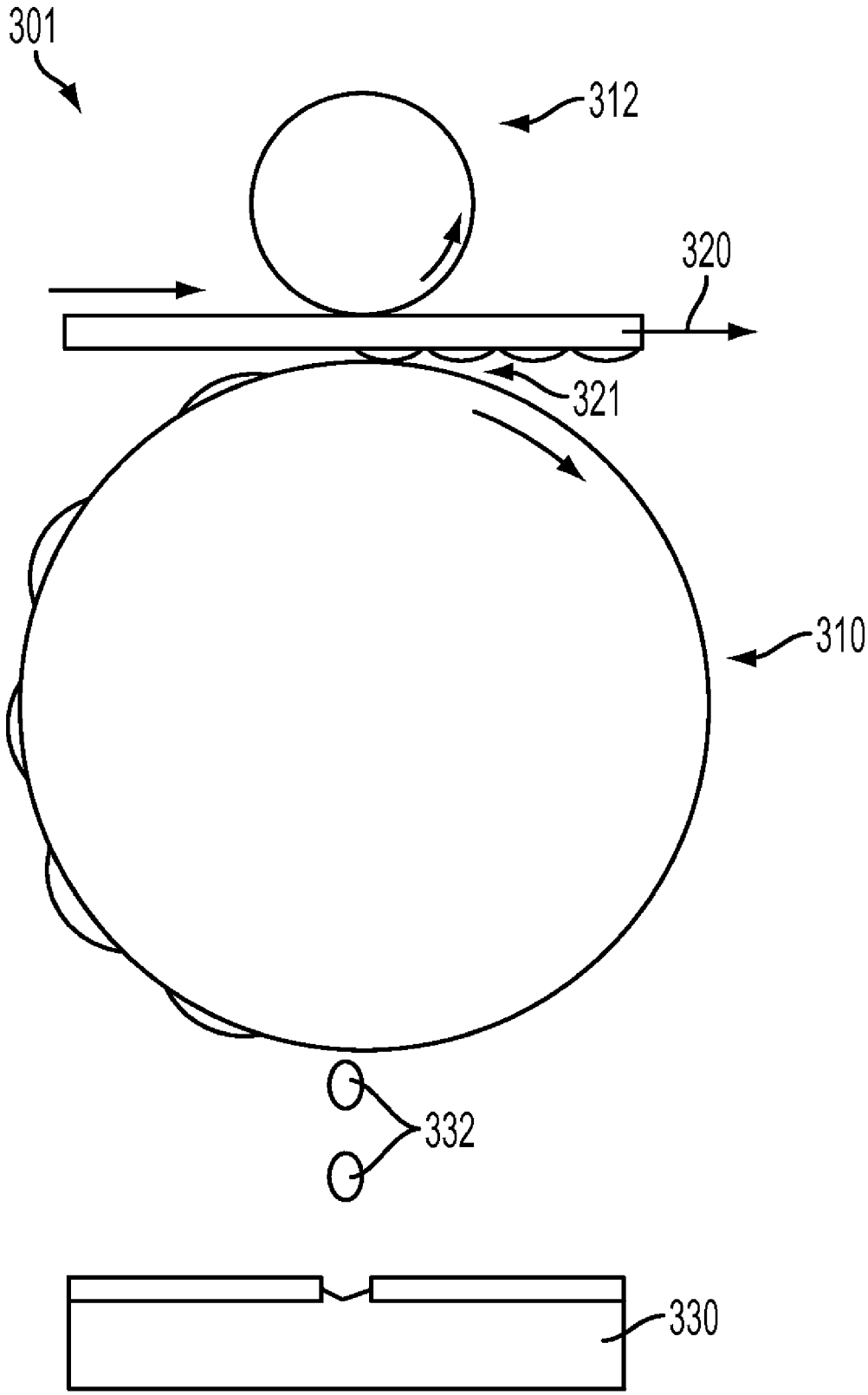
FIG. 14 schematically illustrates another exemplary fuser subsystem of a printing apparatus, according to various embodiments of the present teachings.

FIG. 14 schematically illustrates an alternative fuser subsystem 301 of a solid inkjet printer. The fuser subsystem 301 as illustrated in FIG. 3 can include a solid ink reservoir 330. The solid ink can be melted by heating to a temperature of about 150° C. and the melted ink 332 can then be ejected out of the solid ink reservoir 330 onto a transfix roll 310. In various embodiments, the transfix roll 310 can be kept at a temperature in the range of about 70° C. to about 130° C. to prevent the ink 332 from solidifying. The transfix roll can be rotated and the ink can be deposited onto a media 320, which can be fed through a fusing nip 321 between the transfix roll 310 and a pressure roll 312. The pressure roll 312 can be kept at a room temperature, or it can be heated to a temperature in the range of about 50° C. to about 100° C. In various embodiments, the digital heating elements 180 can be used as a heat source and can be disposed in the transfix roll 310 and/or the pressure roll 312 in a configuration similar to that for the fuser member 410, 410' as disclosed above and shown in FIGS. 15 and 16. In various embodiments, the inclusion of the digital heating element 180 in the transfix roll 310 can allow heating only those parts of the transfix roll 310 that includes ink and correspond to the ink image by selectively addressing one or more micro-heaters 181 of the array of micro-heaters 181.

A method of forming an image may thus include providing an imaging station for forming a latent image on an electrophotographic photoreceptor. The method may also include providing a development subsystem for converting the latent image to a toner image on the electrophotographic photoreceptor. The method can further include providing a fuser subsystem including one or more heating elements for fixing the toner image onto a media, each of the one or more digital heating elements can include an array of micro-heaters, wherein each micro-heater of the array of micro-heaters can be thermally isolated and can be individually addressable. In certain embodiments, each micro-heater can be configured to attain a temperature of up to approximately 200° C. from approximately 20° C. in a time frame of milliseconds. In some embodiments, the step 663 of providing a fuser assembly can include providing the fuser assembly in a roller configuration. In other embodiments, the step of providing a fuser assembly can include providing the fuser assembly in a belt configuration. In some other embodiments, the step of providing a fuser subsystem can include providing one or more of a fuser member, pressure members, external heat rolls, oiling subsystem, and transfix roll. In various embodiments, the method 600 can also include selectively heating one or more micro-heaters that correspond to the toner image to a temperature in the range of approximately 20° C. to approximately 200° C. in a time frame of milliseconds and feeding the media through the fuser subsystem to fix the toner image onto the media. In certain embodiments, the step of selectively heating one or more micro-heaters that correspond to the toner image can include selectively heating a plurality of group of micro-heaters, wherein each group of micro-heaters can be individually addressable. In various embodiments, the step of selectively heating one or more micro-heaters can include heating a first group of micro-heaters to a first temperature, a second group of micro-heaters to a second temperature, the second temperature being different from the first temperature, and so on. One of ordinary skill in the art would know that there can be numerous reasons to heat a first group of micro-heaters to a first temperature, a second set of micro-heaters to a second temperature, the second temperature being different from the first temperature, and so on. Exemplary reasons can include, but are not limited to increasing energy efficiency and improving image quality. For example, in a given media, such as a paper, one can heat certain areas to a higher temperature if those areas have higher toner coverage such as, due to graphic images. Also, one can heat some areas on a media to a higher temperature to increase the glossiness. In some embodiments, the method can further include selectively pre-heating only those parts of the media that correspond to the toner image by selectively heating one or more micro-heaters of the array of micro-heaters that correspond to the toner image. In certain embodiments, the method can further include adjusting an image quality of the image on the media by selectively heating only those parts of the media that corresponds to the image by selectively heating one or more micro-heaters of the array of micro-heaters that correspond to the image.

According to various embodiments, there is a marking method including feeding a media in a marking system, the marking system including one or more digital heating elements, each of the one or more digital heating elements including an array of micro-heaters, wherein each micro-heater can be thermally isolated and can be individually addressable. The marking method can also include transferring and fusing an image onto the media by heating one or more micro-heaters that correspond to the toner image to a temperature in the range of approximately 20° C. to approximately 200° C. in a time frame of milliseconds. The marking method can further include transporting the media to a finisher. In various embodiments, the step of transferring and fusing an image onto the media by heating one or more micro-heaters that correspond to the toner image can include heating a first set of micro-heaters corresponding to a first region of the toner image to a first temperature, a second set of micro-heaters corresponding to a second region of the toner image to a second temperature, wherein the second temperature can be different from the first temperature, and so on. In some embodiments, the marking method can also include selectively pre-heating only those parts of a media that correspond to the toner image by selectively heating one or more micro-heaters of the array of micro-heaters that correspond to the toner image. In certain embodiments, the marking method can also include adjusting an image quality of the image on the media by selectively heating only those portions of the media that corresponds to the image by selectively heating one or more micro-heaters of the array of micro-heaters that correspond to the image.

The techniques described herein may also be used to print variable data with an offset lithographic printer. Variable-data printing is a form of on-demand printing in which elements such as text, images may be changed from one page to the next, without stopping or slowing down the printing process. The conventional lithographic printing techniques include a plate with fixted hydrophilic and hydrophobic patterns. The plate is wet with fountain solution and then inked and the ink image is transferred to a media such as paper. The fountain solution coats the hydrophilic portions of the plate and prevents ink from being deposited on those areas of the plate. In lithographic printing the plate must be changed whenever the printing content is changed. The digital heating elements described herein can be used in digital lithographic printing techniques that can print variable data without changing plates. In one embodiment, the plate is coated with a thermo-responsive wettability switchable material, under which are digital heating elements. The local surface wettability of the plate can be switched between ink-attracting state at one temperature and ink-repelling state at a different temperature.

The digital heating element can selectively heat a thermo-responsive surface to form ink-attracting image area upon which ink can adhere. In another embodiment, the digital heating element is embedded in a blank plate to image-wise remove the thin fountain solution film to form a negative, ink-repelling image. In another embodiment, a blank silicone plate with embedded digital heating element can image-wise heat the waterless lithographic ink to change ink rheology so that ink transfer from silicone plate to the substrate in heated areas.

In the above applications, if differential heating is required, the digital heating element can operate in such a way as to heat a first set of transistor micro-heaters to a first temperature, a second set of transistor micro-heaters to a second temperature, wherein the second temperature is different from the first temperature, and so on.

There are various advantages to using a transistor micro-heater array as described herein, including, but not limited to: (1) the creation of a high resolution, pixel addressable, digital heating element with many potential applications; (2) fast heating with thermal response time in the order of milliseconds; (3) very high energy efficiency; (4) a short heat diffusion distance which reduces the highest temperature in heating device and helps materials last longer with time; and (5) light weight and compact size.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An image marking system comprising: one or more digital heating elements, the digital heating element comprising a micro-heater array having thermally isolated and individually addressable transistor micro-heaters that can attain a temperature up to approximately 200° C. from approximately 20° C. within a few milliseconds.

2. The image marking system of claim 1, wherein the micro-heater array includes more than 1000 transistor micro-heaters.

3. The image marking system of claim 2, wherein the transistor micro-heaters have length and width in between 10 μm and 500 μm.

4. The image marking system of claim 3, wherein the transistor micro-heater comprises a heating transistor and a switching transistor that controls the gate voltage of the heating transistor, and the temperature of the transistor micro-heater is adjustable via the source-gate voltage of the heating transistor.

5. The image marking system of claim 4, wherein the heating transistor may be in the shape of a ring, a polygon, a ribbon, or a spiral.

6. The image marking system of claim 4, wherein the heating transistor has a first conductive layer connected to the source electrode, a second conductive layer connected to the drain electrode, a first electrically insulating layer separating the electrodes from the first electrically insulating layer, a second electrically insulating layer separating the electrodes from the second electrically insulating layer, and a semiconductive layer.

7. The image marking system of claim 1, wherein the digital heating element is disposed on a high temperature flexible substrate or an amorphous silicon drum.

8. The image marking system of claim 1, further comprising a thermal spreading layer disposed over the digital heating elements.

9. The image marking system of claim 8, wherein the thermal spreading layer comprises one or more thermally conductive fillers disposed in a polymer.

10. The image marking system of claim 9, wherein the thermally conductive filler may be selected from the group consisting of graphites, graphenes, carbon nanotubes, micron to submicron sized metal particles, and micron to submicron sized ceramic fillers.

11. The image marking system of claim 9, wherein the polymer may be selected from the group consisting of polyimides, silicones, fluorosilicone, and fluoroelastomers.

12. The image marking system of claim 4, wherein the micro-heater array further comprises a data driver providing data drive lines connected to the source electrodes of the switching transistors and a scan driver providing scan drive lines connected to the gate electrodes of the switching transistors.

13. The image marking system of claim 12, wherein the micro-heater array is addressed by a passive matrix drive.

14. The image marking system of claim 12, wherein each micro-heater in the array further comprises a capacitor that holds the source-gate voltage of the heating transistor after the micro-heater is addressed, and micro-heater array is addressed by an active matrix drive.

15. The image marking system of claim 1, wherein the image marking system is in a roller configuration or a belt configuration.

16. The image marking system of claim 1, wherein the image marking system is one of a electrophotographic printer, a liquid inkjet printer, and a solid inkjet printer, a digital lithographic printer.

17. A method of forming an image comprising: forming a toner or ink image on an imaging member; and providing a fixing subsystem comprising one or more digital heating elements, wherein the digital heating element comprises a micro-heater array having thermally isolated and individually addressable transistor micro-heaters; selectively heating one or more transistor micro-heaters that correspond to the toner or ink image to a temperature in the range of approximately 20° C. to approximately 200° C. in a few milliseconds; and feeding the media through the fuser subsystem to fix the toner or ink image on the media.

18. The method of claim 17, wherein the step of selectively heating one or more transistor micro-heaters comprises heating a first set of micro-heaters to a first temperature, heating a second set of micro-heaters to a second temperature, the second temperature is different from the first temperature, and so on.

19. The method of claim 17, wherein the step of forming a toner image comprises providing an imaging station for forming a latent image on an electrophotographic photoreceptor and providing a development subsystem for converting the latent image to a toner or liquid toner image on the electrophotographic photoreceptor.

20. The method of claim 17, wherein the step of forming an ink image comprises providing an inkjet development subsystem for forming a liquid ink or solid ink image on an imaging member.

21. A method of forming an ink image comprising: feeding a media in a digital lithographic development subsystem comprising an imaging member, wherein the imaging member comprises a wettability switchable surface and one or more digital heating elements that comprise an array of transistor micro-heaters, wherein each micro-heater is thermally isolated and individually addressable; changing the surface of the imaging member on the image areas from ink-repelling state to ink-attracting state by heating one or more micro-heaters that correspond to the image areas to a temperature in the range of approximately 20° C. to approximately 200° C. in a few milliseconds; forming an ink image by applying ink to the image areas that are ink-attracting; transferring the ink image from the imaging member onto the media; and transporting the media to a fixing station.

22. A method of forming an ink image comprising: feeding a media in a digital lithographic development subsystem comprising an imaging member, wherein the imaging member comprises a wettability switchable surface and one or more digital heating elements that comprise an array of transistor micro-heaters, wherein each micro-heater is thermally isolated and individually addressable; applying a thin fountain solution film on the imaging member; removing fountain solution from the image areas by heating one or more micro-heaters that correspond to the image areas to a temperature in the range of approximately 20° C. to approximately 200° C. in a few milliseconds; forming a ink image by applying ink to the image areas where fountain solution is removed; transferring ink image onto the media; and transporting the media to a fixing station.

23. A method of forming an ink image comprising: feeding a media in a digital lithographic development subsystem comprising an imaging member, wherein the imaging member comprises a wettability switchable surface and one or more digital heating elements that comprise an array of transistor micro-heaters, wherein each micro-heater is thermally isolated and individually addressable; applying a waterless lithographic ink film on the imaging member; changing the rheological properties of the waterless lithographic ink on the image areas by heating one or more micro-heaters that correspond to the image areas to a temperature in the range of approximately 20° C. to approximately 200° C. in a few milliseconds; transferring the rheology-modified ink image from imaging member onto the media; and transporting the media to a fixing station.

* * * * *